US009015963B1

(12) United States Patent
Dominguez

(10) Patent No.: US 9,015,963 B1
(45) Date of Patent: Apr. 28, 2015

(54) REMOVABLE SHOE WEDGE

(71) Applicant: Lauren Dominguez, Canyon Lake, CA (US)

(72) Inventor: Lauren Dominguez, Canyon Lake, CA (US)

( * ) Notice: Subject to any disclaimer, the term of this patent is extended or adjusted under 35 U.S.C. 154(b) by 0 days.

(21) Appl. No.: 14/259,360

(22) Filed: Apr. 23, 2014

(51) Int. Cl.
*A43B 21/42* (2006.01)
*A43B 21/52* (2006.01)

(52) U.S. Cl.
CPC ..... *A43B 21/52* (2013.01); *A43B 21/42* (2013.01)

(58) Field of Classification Search
CPC ..... A43B 21/42; A43B 21/22; A43B 21/37; A43B 21/47
USPC ..... 36/42, 100, 72 B, 15, 41
See application file for complete search history.

(56) References Cited

U.S. PATENT DOCUMENTS

| | | | | |
|---|---|---|---|---|
| 1,743,543 | A | 1/1930 | Gutierrez | |
| 1,769,758 | A * | 7/1930 | Siese, Jr. | 36/72 B |
| 1,841,027 | A * | 1/1932 | Gruber | 36/72 B |
| 1,955,159 | A * | 4/1934 | Winget | 36/72 B |
| 2,076,514 | A * | 4/1937 | Huffman | 36/34 B |
| 2,109,193 | A * | 2/1938 | Field et al. | 36/72 B |
| 2,795,866 | A | 6/1957 | Andre | |
| 3,608,213 | A * | 9/1971 | Jensen | 36/34 R |
| D268,376 | S * | 3/1983 | Scharf | D2/915 |
| 4,610,100 | A | 9/1986 | Rhodes | |
| 7,168,184 | B2 | 1/2007 | Wallin | |
| 2006/0196082 | A1 * | 9/2006 | Robbins | 36/42 |

FOREIGN PATENT DOCUMENTS

WO WO2013187543 * 12/2013

* cited by examiner

*Primary Examiner* — Ted Kavanaugh
(74) *Attorney, Agent, or Firm* — Fish & Richardson P.C.

(57) ABSTRACT

A shoe wedge includes a support structure. The support structure includes two longitudinally extending wall portions that are biased towards one another such that the wall portions define a channel extending between the wall portions and an opening that extends from an upper surface of the support structure to a lower surface of the support structure. The opening has a larger cross sectional area at the upper surface than at the lower surface. The shoe wedge further includes a body portion that extends from the support structure. The body portion is configured with a surface that substantially conforms to a portion of a sole of a shoe.

14 Claims, 3 Drawing Sheets

REMOVABLE SHOE WEDGE

TECHNICAL FIELD

The subject matter of this disclosure relates to shoes.

BACKGROUND

Shoes come in variety of forms. For example, some shoes are heeled shoes that include a projection, e.g., a heel, at the back and along a bottom portion of the upper portion of the shoe that increases the height of the back of the shoe. Another type of shoe is a wedge shoe. Wedge shoes may similarly increase the height of the back of the shoe, but instead of a projection at the back and along a bottom portion of the upper portion of the shoe, the wedge shoe may include a wedge along a bottom portion of the upper portion of the shoe.

SUMMARY

In general, an aspect of the subject matter described in this specification may involve a shoe wedge that may be removeably coupled to a heel of a shoe. The removable shoe wedge may enable a shoe to be worn as a heeled shoe or as a wedge shoe. For example, in instances when greater stability is desired, e.g., walking on ground that is uneven, or when walking in a high-heeled shoe is undesirable, e.g., walking on muddy ground or gravels, a shoe wedge may be removeably coupled to a heel of a shoe. In instances when less stability is needed, e.g., walking on even ground, the removable shoe wedge may be uncoupled from the heel of the shoe.

In another example, a heeled shoe may be worn without the removable shoe wedge for more formal occasions and worn with the removable shoe wedge for less formal occasions. Additionally or alternatively, shoe wedges with different appearances may be interchanged. For example, the shoe wedges may come in different colors, e.g., red, blue, green, etc., different patterns, e.g., polka dots, solid, stripes, checkered, etc., and different materials, e.g., leather, plastic, rubber, etc. A particular removable shoe wedge may be coupled to the shoe to match a particular outfit.

In some aspects, the subject matter described in this specification may be embodied in a shoe wedge. The shoe wedge may include a support structure including two longitudinally extending wall portions. The two longitudinally extending wall portions may be biased towards one another such that the wall portions define a channel extending between the wall portions and an opening that extends from an upper surface of the support structure to a lower surface of the support structure. The opening may have a larger cross sectional area at the upper surface than at the lower surface. The shoe wedge may further include a body portion that extends from the support structure. The body portion may be configured with a surface that substantially conforms to a portion of a sole of a shoe.

In some aspects, the subject matter described in this specification may be embodied in actions of placing a shoe wedge proximate to a heel of a shoe and moving the shoe wedge against the heel such that a portion of the heel passes through a channel defined by two longitudinally extending wall portions, of the shoe wedge, that are biased towards each other and into an opening defined by the two longitudinally extending wall portions. Further actions include positioning a surface of a body portion of the shoe wedge that extends from the wall portions against a portion of the shoe.

In some aspects, the subject matter described in this specification may be embodied in a system including a shoe and a shoe wedge. The shoe may include a heel and a sole. The shoe wedge may include a support structure including two longitudinally extending wall portions. The two longitudinally extending wall portions may be biased towards one another such that the wall portions define a channel extending between the wall portions and an opening that extends from an upper surface of the support structure to a lower surface of the support structure. The opening may have a larger cross sectional area at the upper surface than at the lower surface. The shoe wedge may further include a body portion that extends from the support structure. The body portion may be configured with a surface that substantially conforms to a portion of a sole of the shoe.

These and other versions may each optionally include one or more of the following features. For instance, in some implementations the support structure is configured such that as a portion of a heel of the shoe passes through the channel, the wall portions move away from each other to receive the portion of the heel of the shoe in the opening.

In some aspects, the support structure includes a coupling member that is configured to couple with a groove in a heel of the shoe. In certain aspects, the shoe wedge further includes clips, disposed at a periphery of the body portion, that are configured to releasably couple the body portion to the shoe. In some implementations, the wall portions include curved surfaces defining the channel. In some aspects, the shoe wedge further includes a coupling member that extends into the opening defined by the wall portions, the coupling member configured to couple with a hole formed in a heel of the shoe. In certain aspects, the support structure is inside the body portion.

In some implementations, moving the shoe wedge against the heel such that the portion of the heel passes through a channel defined by two longitudinally extending wall portions causes a coupling member to couple with a groove in the heel of the shoe. In some aspects, the actions further include releasably coupling clips disposed at a periphery of the body portion with the shoe. In certain aspects, the actions further include coupling a coupling member that extends into the opening defined by the wall portions into a hole defined in the heel of the shoe. In some implementations, moving the shoe wedge against the heel causes the two longitudinally extending wall portions to move away from each other until the portion of the heel passes into the opening defined by the two longitudinally extending wall portions such that the portion of the heel is retained within the opening.

The details of one or more embodiments of the subject matter are set forth in the accompanying drawings and the description below. Other features, objects, and advantages of the subject matter will be apparent from the description and drawings, and from the claims.

DESCRIPTION OF DRAWINGS

Like reference symbols in the various drawings indicate like elements

DETAILED DESCRIPTION

Figure 1:
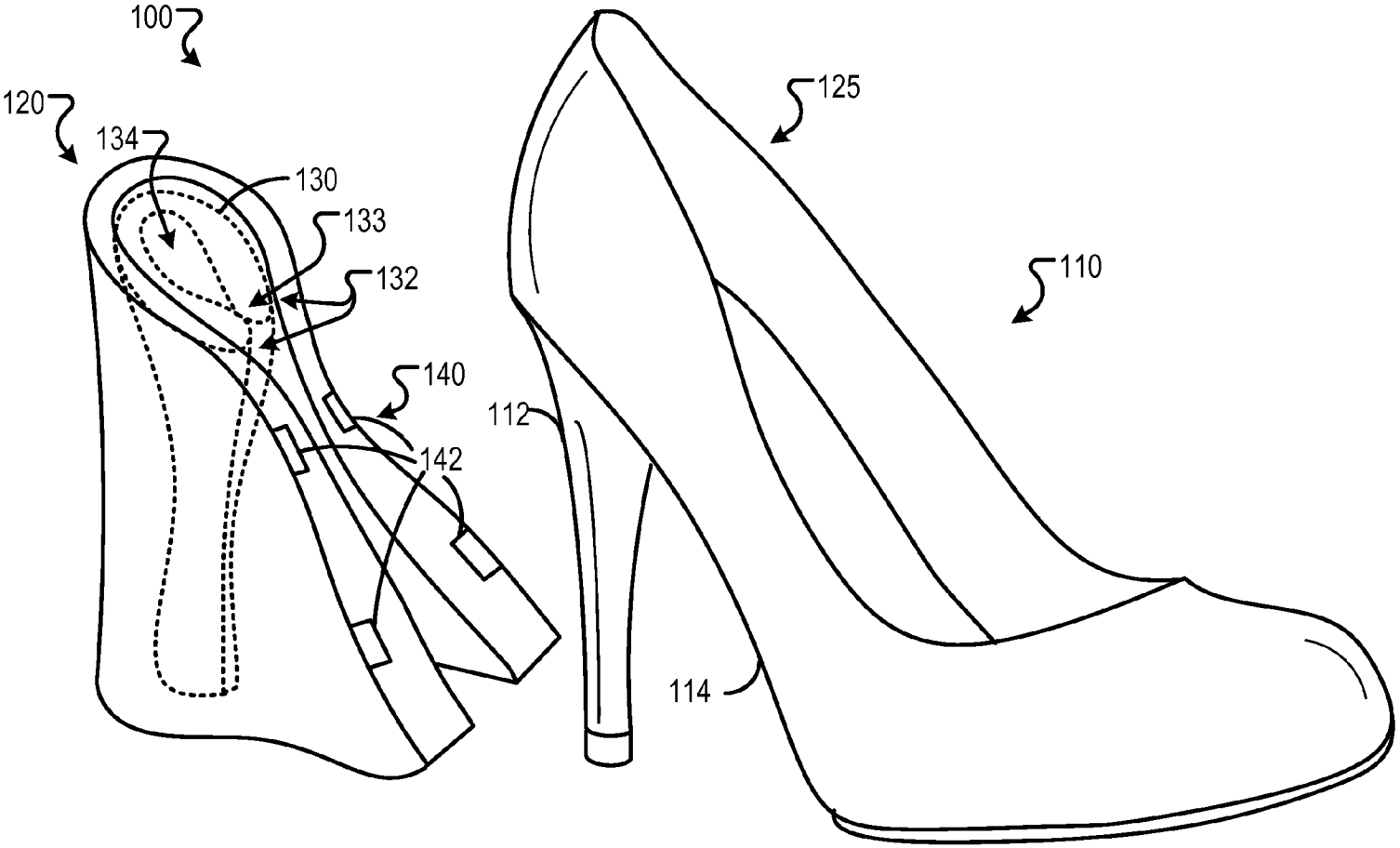
FIG. 1 shows an isometric view of a system including a heeled shoe and a shoe wedge, according to a particular embodiment.

Referring to FIG. 1, a system 100 includes a heeled shoe 110 and a shoe wedge 120, according to a particular embodiment. The heeled shoe 110 may include a heel 112 and a sole 114. The heel 112 of the shoe 110 may be at the back of the shoe 110 extending to the ground or flat surface upon which the shoe 110 sits. The sole 114 of the shoe 110 may be the bottom of the shoe 110 from where the heel 112 starts extending to the ground to the front of the shoe 110 so that the sole 114 of the shoe 110 contacts the ground near the front of the shoe 110. The shoe 110 also includes an upper portion 125.

The shoe wedge 120 may include a support structure 130 and a body portion 140. The support structure 130 may be disposed at the back portion of the shoe wedge 120. The support structure 130 may include two longitudinally extending wall portions 132 that are biased towards one another. The wall portions 132 may be biased towards one another so that they are in contact with one another, or have a small gap between one another. The wall portions 132 may be part of the same piece. For example, the wall portions 132 may be two sides of a "U" or horseshoe shaped piece.

The wall portions 132 may define a channel 133. The channel 133 may extend between the wall portions 132. The channel 133 may initially be closed if the wall portions 132 are biased so that they contact each other. However, the channel 133 may widen as the distance between the wall portions 132 increases.

The wall portions may also define an opening 134. The opening 134 may extend from an upper surface of the support structure 130 to a lower surface of the support structure 130. The upper surface of the support structure 130 may be considered the portion of the support structure 130 that is furthest from the ground or surface upon which the shoe 110 sits. The lower surface of the support structure 130 may be considered the portion of the support structure 130 that is closest to the ground or surface upon which the shoe 110 sits. The opening 134 may have a larger cross sectional area at the upper surface than at the lower surface.

The parts of the wall portions 132 that are closest towards one another may have curved surfaces. The curved surfaces may guide the heel 112 of the shoe 112 so that when the heel 112 of the shoe 110 pushes against the support structure 130, the heel 112 of the shoe 110 is guided into the channel 133. Using curved surfaces may also reduce or prevent scratching of the heel 112 by the wall portions 132.

The support structure 130 may function as a clip to secure the heel 112 inside the support structure 130 by elastic force. The support structure 130 may be substantively elastic, meaning that the support structure 130 may be deformed from an initial shape by force and return to its initial shape after the force is removed. For example, the wall portions 132 may be biased towards one another so that as the heel 112 of the shoe 110 pushes against the wall portions 132 at the channel 133, the wall portions 132 move apart to widen the channel 133 and allow the heel 112 of the shoe 110 to pass through the channel 133 into the opening 134. Once the heel 112 passes through the channel 133 into the opening 134, the wall portions 132 may then move closer together to narrow the channel 133 and secure the heel 112 within the support structure 130.

The support structure 130 may be made entirely of a substantively elastic material, e.g., plastic, foam, rubber, etc. Additionally or alternatively, a portion of the support structure 130 may be made of a substantively elastic material so that the wall portions 132 may elastically deform, but a remaining portion of the support structure 130 may be made of a substantively non-elastic material, e.g., glass, wood, metal, etc. For example, the back portion of the support structure 130 may be made of a substantively elastic material but the wall portions 132 may be made of a substantively non-elastic material that is coupled to the substantively elastic material.

The body portion 140 of the shoe wedge 120 may extend from the support structure 130. For example, as shown in FIG. 1, the body portion 140 of the shoe wedge 120 may wrap around the support structure 130 and extend as shown to the right of the support structure 130. The body portion 140 may be coupled to the back of the support structure 130. For example, the body portion 140 may be glued to the support structure 130, fused to the support structure 130, or molded as part of the support structure 130.

The body portion 140 may extend from the support structure 130 and define a surface that substantially conforms to a portion of the sole 114 of the shoe 110. For example, the body portion 140 may be shaped to contact the portion of the sole 114 of the shoe that is above the ground when the heel 112 of the shoe 110 is secured in the opening 134 defined by the support structure 130 of the shoe wedge 120.

The body portion 140 may support the support structure 130 and may support the sole of the shoe 114. For example, the back of the support structure 130 may be coupled to the body portion 140 and a surface of the body portion 140 may be in contact with the sole 114 of the shoe 110.

The body portion 140 may include clips 142 that may releasably couple to the sole 114 of the shoe 110. The clips may be elastically deformed to secure around a portion of the sole 114 of the shoe 110. For example, the edges of the sole 114 of the shoe 110 may be rounded so that the clips 142 may be pulled up around the edges of the sole 114 of the shoe 110 and then elastically return down to wrap around the edges of the sole 114 of the shoe 110. Additionally or alternatively, the clips 142 may be non-elastic so that the clips 142 may be pulled up around the edges of the sole 114 of the shoe 110 and then pushed down to wrap around the edges of the sole 114.

FIG. 1 depicts the clips 142 as rectangular shaped clips 142 around a periphery of the body portion 140, where a first clip is disposed on the middle of the upper surface of one side of the body portion 140, a second clip is disposed on the bottom area of the upper surface of the one side of the body portion 140, a third clip is disposed on the middle of the upper surface of another side of the body portion 140, and a fourth clip is disposed on the bottom area of the upper surface of the other side of the body portion 140. However, different shaped clips 142 may be used, e.g., square, circular, triangular, etc., different sized clips 142 may be used, e.g., smaller or larger, different number of clips may be used, fewer or more, and differently disposed clips may be used, e.g., clips 142 shifted to be closer together, further apart, or further up the body portion 140, etc.

The body portion 140 may hide the support structure 130 and may be the only portion of the shoe wedge 120 that is visibly apparent when the shoe 110 is coupled to the shoe wedge 120. For example, when the shoe wedge 120 and shoe 110 are coupled together, the support structure 130 and clips 142 may be hidden from view and the clips 142 may be non-obtrusive so not visibly apparent. The body portion 140 may have different appearances. For example, the body portion 140 may be different colors, e.g., red, blue, green, etc., different patterns, e.g., polka dots, solid, stripes, checkered, etc., and different materials, e.g., leather, plastic, rubber, etc.

In some implementations, the shape, e.g., height and width, of the heel 112 may be different from that shown in FIG. 1, and the shape, e.g., height and width, of the support structure 130 and body portion 140 may also be correspondingly different. For example, the heel 112 may be taller, and the support structure 130 and the body portion 140 may be correspondingly taller. Conversely, the heel 112 may be shorter, and the support structure 130 and the body portion 140 may be correspondingly shorter.

Figure 2:
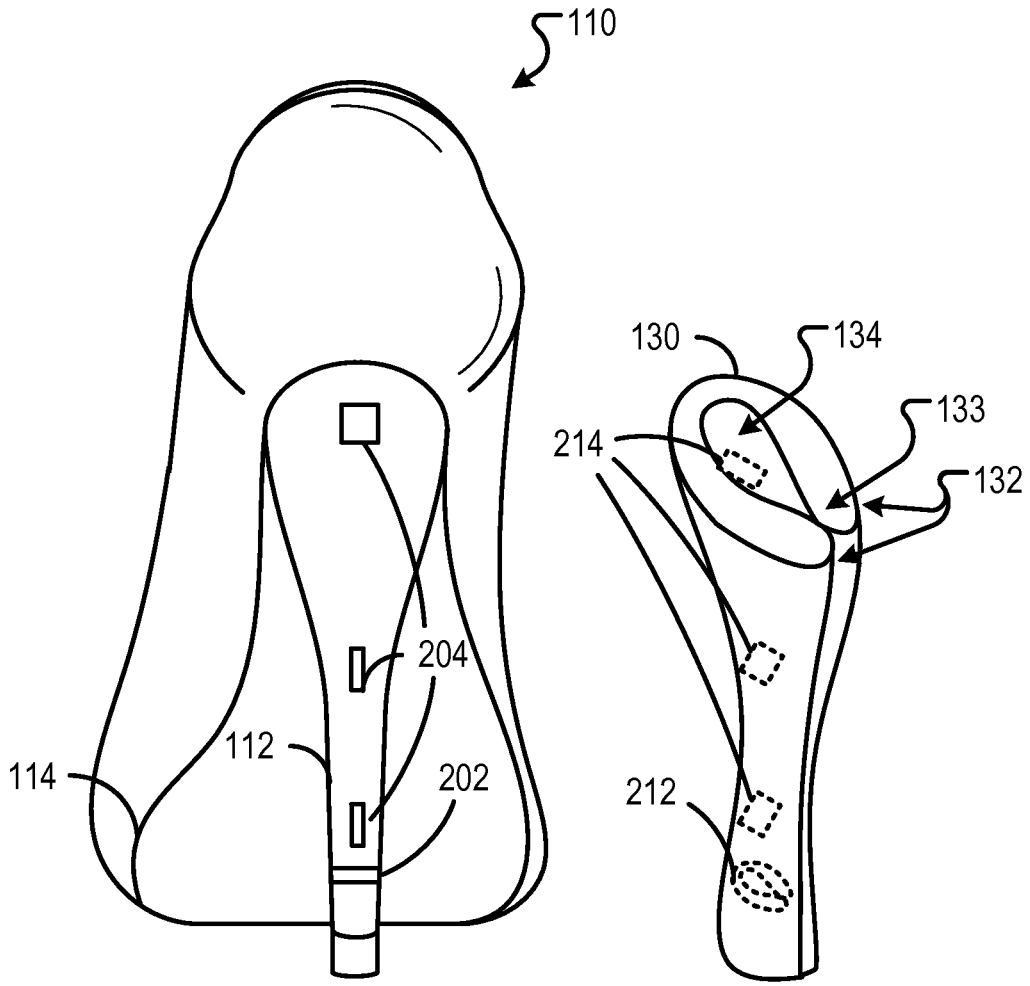
FIG. 2 shows a back view of a shoe and coupling members of a support structure according to a particular embodiment.

FIG. 2 shows a back view of the shoe 110 and coupling members 212, 214 of the support structure 130 according to a particular embodiment. As described above, the shoe 110 may include a heel 112 and a sole 114. The heel 112 may define a groove 202 near the bottom of the heel 114. The groove 202 may extend longitudinally, relative to the ground, around the back side of the bottom of the heel 114, and may extend around the bottom of the heel 114 to form a circular groove 202.

The groove 202 may be configured to be coupled with a coupling member 212 of the support structure 130. The coupling member 212 of the support structure 130 may be a U-shaped or horseshoe shaped elastic structure that may wrap around a portion of the groove 202 and secure the bottom of the heel 114 to the support structure 130. The coupling member 212 of the support structure 130 may correspondingly be disposed near the bottom of the support structure 130 and extend into the opening 134 defined by the wall portions 132 of the support structure 130. When the groove 202 is coupled with the coupling member of the support structure 130, the groove 202 and coupling member 212 may reduce or prevent vertical movement of the shoe 110 relative to the shoe wedge 120. In some implementations, the groove 202 and the coupling member 212 may be disposed further up the heel 112 and support structure 130, respectively.

The heel 112 may additionally or alternatively include slits, holes, or openings 204. The openings 204 may be shaped liked squares, rectangles, circles, or various other shapes. The openings 204 may be configured to receive coupling members 214 in the support structure 130. The openings 204 and coupling members 214 may be correspondingly shaped and positioned so that when the shoe 110 and the shoe wedge 120 are coupled together, the coupling members 214 are received in the openings 204. The receipt of the coupling members 214 in the openings 204 may permit the shoe 110 and the shoe wedge 120 to be decoupled by pulling the shoe 110 and the shoe wedge 120 apart in a horizontal direction and prevent vertical movement between the shoe 110 and the shoe wedge 120. For example, when the coupling members 214 are received in the openings 204, the heel 112 may still be pulled through the channel 133 in the front of the support structure 130 but prevented from lifting up out of the opening 134 defined by the wall portions 132. The openings 204 may be formed partially through the width of the heel 112 or extend all the way through the heel 112.

The groove 202 and openings 204 of the heel 112 and the coupling members 214 and 212 of the support structure 130 may be optional. For example, in some implementations, the heel 112 may include the groove 202 but not the openings 204 and the support member 130 may include the coupling member 212 but not the coupling members 214. In another implementation, the heel 112 may include the openings 204 but not the groove 202 and the support member 130 may include the coupling members 214 but not the coupling member 212. In yet another implantation, the heel 112 may not include both the openings 204 and the groove 202 and the support member 130 may not include both the coupling members 214 and the coupling member 212.

Figure 3:
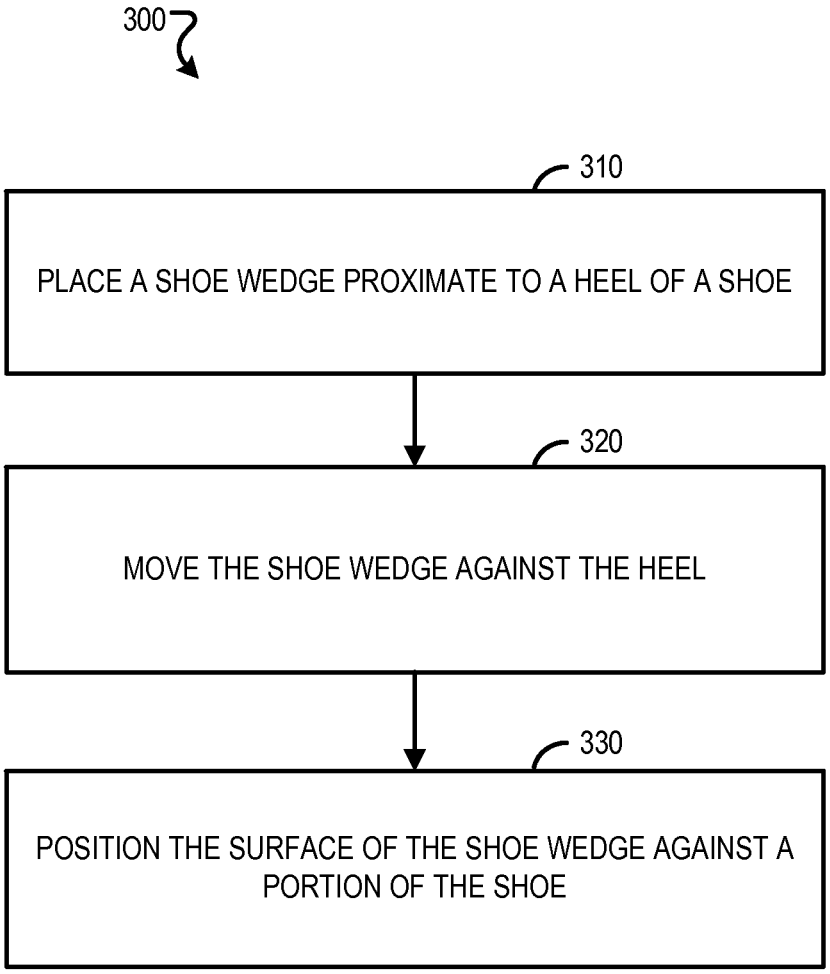
FIG. 3 is a flowchart of an example process for coupling a shoe wedge with a heel of a shoe.

FIG. 3 is a flowchart of an example process 300 for coupling a shoe wedge with a heel of a shoe. The following describes the processing 300 as being performed by components of the system 100 that are described with reference to FIG. 1. However, the process 300 may be performed by other systems or system configurations.

The shoe 110 and the shoe wedge 120 may be coupled together by the actions of placing the shoe wedge 120 proximate to the heel 112 of the shoe 110 (310). For example, the shoe wedge 120 may be placed in the left hand and the shoe 110 may be placed in the right hand so that the front of the shoe wedge 120 is closest to the heel 112 of the shoe 110.

The actions may further include moving the shoe wedge 120 against the heel 112 such that a portion of the heel 112 passes through the channel 133 defined by the two longitudinally extending wall portions 132 that are biased towards each other and into the opening 134 defined by the two longitudinally extending wall portions 132 (320). For example, the shoe 110 and the shoe wedge 120 may be brought together by moving the left and right hand horizontally together. This movement may cause the coupling member 212 to couple with the groove 202 in the heel 112 of the shoe 110 and cause the coupling members 214 to couple with the holes 204 defined in the heel 112 of the shoe 110.

The actions may further include positioning a surface of a body portion 140 of the shoe wedge 120 that extends from the wall portions against a portion of the shoe 110 (330). For example, the shoe 110 and the shoe wedge 120 may be pushed together until sole 114 of the shoe contacts the upper surface of the body portion 140. The actions may further include releasably coupling clips disposed at a periphery of the body portion with the shoe.

A number of embodiments of the invention have been described. Nevertheless, it will be understood that various modifications may be made without departing from the spirit and scope of the invention. Accordingly, other embodiments are within the scope of the following claims.

What is claimed is:

1. A shoe wedge comprising:

a support structure including two longitudinally extending wall portions that are biased towards one another, parts of the wall portions that are closest to one another in the biased position including areas that are substantially curved, the wall portions defining:

a channel extending between the wall portions; and an opening that extends from an upper surface of the support structure to a lower surface of the support structure, the opening having a larger cross sectional area at the upper surface than at the lower surface; and a body portion that extends from the support structure, the body portion configured with a lower surface that is generally flat and an upper surface shaped to substantially conform to a portion of a sole of a shoe and generally sloped relative to the lower surface, wherein a portion of the support structure is disposed within and coupled to the body portion.

2. The shoe wedge of claim 1, wherein the support structure is configured such that as a portion of a heel of the shoe passes through the channel, the wall portions move away from each other to receive the portion of the heel of the shoe in the opening.

3. The shoe wedge of claim 1, wherein the support structure includes a coupling member that is configured to couple with a groove in a heel of the shoe.

4. The shoe wedge of claim 1, further comprising clips, disposed at a periphery of the body portion, that are configured to releasably couple the body portion to the shoe.

5. The shoe wedge of claim 1, wherein the wall portions comprise curved surfaces defining the channel.

6. The shoe wedge of claim 1, further comprising a coupling member that extends into the opening that extends from the upper surface of the support structure to the lower surface of the support structure, the coupling member configured to couple with a hole formed in a heel of the shoe.

7. The shoe wedge of claim 1, wherein the support structure is inside the body portion.

8. A system comprising:

a shoe including a heel and a sole; and a shoe wedge, the shoe wedge including:

a support structure including two longitudinally extending wall portions that are biased towards one another, parts of the wall portions that are closest to one another in the biased position including areas that are substantially curved, the wall portions defining:

a channel extending between the wall portions; and an opening that extends from an upper surface of the support structure to a lower surface of the support structure, the opening having a larger cross sectional area at the upper surface than at the lower surface; and a body portion that extends from the support structure, the body portion configured with a lower surface that is generally flat and an upper surface shaped to substantially conform to a portion of a sole of a shoe and generally sloped relative to the lower surface, wherein a portion of the support structure is disposed within and coupled to the body portion.

9. The system of claim 8, wherein the support structure is configured such that as a portion of the heel of the shoe passes through the channel, the wall portions move away from each other to receive the portion of the heel of the shoe in the opening.

10. The system of claim 8, wherein the support structure includes a coupling member that is configured to couple with a groove in the heel of the shoe.

11. The system of claim 8, further comprising clips, disposed at a periphery of the body portion, that are configured to releasably couple the body portion to the shoe.

12. The system of claim 8, wherein the wall portions comprise curved surfaces defining the channel.

13. The system of claim 8, further comprising a coupling member that extends into the opening that extends from the upper surface of the support structure to the lower surface of the support structure.

14. The system of claim 8, wherein the support structure is inside the body portion.

* * * * *